US011062896B1

(12) United States Patent
Dan et al.

(10) Patent No.: US 11,062,896 B1
(45) Date of Patent: Jul. 13, 2021

(54) HIGH-PRESSURE DISCHARGE LAMP

(71) Applicant: Ushio Denki Kabushiki Kaisha, Tokyo (JP)

(72) Inventors: Masashi Dan, Tokyo (JP); Tomoyoshi Arimoto, Tokyo (JP); Takumi Yamane, Tokyo (JP); Taro Arimoto, Tokyo (JP); Shinji Nikawa, Tokyo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/056,633

(22) PCT Filed: Feb. 7, 2019

(86) PCT No.: PCT/JP2019/004358
§ 371 (c)(1),
(2) Date: Nov. 18, 2020

(87) PCT Pub. No.: WO2019/225067
PCT Pub. Date: Nov. 28, 2019

(30) Foreign Application Priority Data

May 22, 2018 (JP) ..... JP2018-097692

(51) Int. Cl.
*H01J 61/06* (2006.01)
*H01J 61/073* (2006.01)

(52) U.S. Cl.
CPC ..... *H01J 61/0735* (2013.01)

(58) Field of Classification Search
CPC ..... H01J 61/0735; H01J 61/0737
USPC ..... 313/311
See application file for complete search history.

(56) References Cited

U.S. PATENT DOCUMENTS

2012/0181925 A1* 7/2012 Arimoto ..... H01J 61/86 313/633
2014/0017114 A1* 1/2014 Matsuo ..... H01B 1/02 420/431
2016/0192462 A1* 6/2016 Kono ..... H01J 61/86 315/205

(Continued)

FOREIGN PATENT DOCUMENTS

JP H11-154487 A 6/1999
JP H11339713 A 12/1999

(Continued)

OTHER PUBLICATIONS

Translation of the International Preliminary Report on Patentability Chapter 1 and Translation of Written Opinion of the International Searching Authority; PCT/JP2019/004358; dated Nov. 24, 2020.

(Continued)

*Primary Examiner* — Christopher M Raabe
(74) *Attorney, Agent, or Firm* — Studebaker & Brackett PC

(57) ABSTRACT

A high-pressure discharge lamp includes a cathode body composed of a cathode made of tungsten or tungsten alloy and a lead rod inserted in a lead rod insertion hole of the cathode. The cathode has a carbonized layer made of tungsten carbide ($W_2C$) formed on a surface thereof exposed to a discharge space (except for a tip portion thereof) and on an inner surface of the lead rod insertion hole. The carbonized layer contains carbon in an amount of 0.44 g/cc to 0.53 g/cc.

3 Claims, 2 Drawing Sheets

(56) References Cited

U.S. PATENT DOCUMENTS

| | | | | |
|---|---|---|---|---|
| 2017/0062200 | A1* | 3/2017 | Minayeva | H01J 9/042 |
| 2019/0362959 | A1* | 11/2019 | Shimozato | H01J 61/0732 |

FOREIGN PATENT DOCUMENTS

| | | | |
|---|---|---|---|
| JP | 2012-150951 | A | 8/2012 |
| WO | 2017-002542 | A1 | 1/2017 |

OTHER PUBLICATIONS

International Search Report issued in PCT/JP2019/004358; dated Apr. 2, 2019.

* cited by examiner

HIGH-PRESSURE DISCHARGE LAMP

TECHNICAL FIELD

The present invention relates to a high-pressure discharge lamp having a cathode made of tungsten or tungsten alloy, and more particularly to a high-pressure discharge lamp applied to the light source of a cinematographic projector, the light source used for exposure purposes in semiconductor or liquid crystal production fields, or to the light source used in analysis applications.

BACKGROUND ART

High-pressure discharge lamps are used for digital cinema projectors, exposure devices, and light sources in analysis applications in combination with an optical system as a light source with high light collection efficiency, because of its nature similar to a point light source due to the short distance between the tips of a pair of electrodes arranged opposite each other inside an arc tube.

A xenon lamp for use in a digital projector described in JP-A-2012-150951 (Patent Document 1) is one example of such high-pressure discharge lamps.

FIG. 3 illustrates this conventional high-pressure discharge lamp. A fused quartz arc tube 10 of the high-pressure discharge lamp includes a substantially spherical light-emitting part 11 positioned at the center, and sealed tubes 12 on both ends thereof. A cathode 21 and an anode 31 made of a high-melting point material such as tungsten and the like are disposed to face each other in the discharge space S inside the light-emitting part 11. This discharge space S is hermetically filled with xenon that is a light-emitting substance.

A cathode lead rod 22 and an anode lead rod 32 are respectively inserted into the cathode 21 and the anode 31. The cathode lead rod 22 and the anode lead rod 32 are sealed by sealing parts 13 of the sealed tubes 12.

As illustrated in FIG. 4, the cathode 21 is provided with a tungsten carbide ($W_2C$) layer 40 on its tapered part 21*a* so that carbon (C) is supplied to the part at the tip of the cathode 21 that will be in contact with the arc during the illumination as will be described later in detail.

The example illustrated in FIG. 4 is not formed with the tungsten carbide ($W_2C$) layer 40 in a tip portion 21*b* of the tapered part 21*a*.

FIG. 5 illustrates a schematic of the series of reactions inside the light-emitting part of the high-pressure discharge lamp.

The OH group contained in the inner surface layer of the fused quartz light-emitting part 11 is released into the discharge space S as water ($H_2O$), for example, during the illumination of the lamp. The released $H_2O$ reacts with carbon or carbon compound of the tungsten carbide layer 40 provided on the surface of the cathode 21 in the light-emitting part 11 mainly on the cathode surface, as a result of which carbon monoxide gas (CO) is generated.

This CO in the gaseous state diffusing inside the discharge space S of the light-emitting part 11 partly enters the arc A. Inside the arc A, the CO is heated and decomposed so that C+ ions are generated. The generated C+ ions are transported toward the tip of the cathode by the electric fields inside the arc A, where the ions react with the tungsten W of the cathode 21 and form tungsten carbides such as $W_2C$ and WC.

The tungsten carbide formed on the surface at the tip of the cathode melts on the surface of cathode tip by the heat, in particular, when the lamp is turned on so that the surface of cathode tip is maintained smooth. This prevents formation of irregularities on the surface of cathode tip and allows for stable discharge.

Cathodes of such high-pressure discharge lamps, in particular xenon short arc lamps for use in digital projectors, are sometimes used under very harsh conditions with high operating pressure and high current density at the cathode tip.

Continuous illumination under these conditions leads to deformation and irregularities of the cathode tip, which causes the discharge point to move around (arc-jump), and thus flickering starts. This is because the carbon in the tungsten carbide ($W_2C$) layer 40 decreases with the progress of time in which the lamp is illuminated, which makes the series of reactions illustrated in FIG. 5 harder to occur.

Namely, the decrease in carbon C in the tungsten carbide ($W_2C$) layer 40 leads to reduction of carbon monoxide CO in the discharge space S of the light-emitting part 11 and reduction of C+ ions in the arc, because of which tungsten carbides such as $W_2C$ and WC are formed less or not formed at all at the tip of the cathode 21. This causes formation of irregularities on the surface of cathode tip, resulting in the start of flickering.

PRIOR ART DOCUMENTS

Patent Document

Patent Document 1: JP-A-2012-150951

SUMMARY OF THE INVENTION

Problems to be Solved by the Invention

In view of the issue in the prior art described above, one problem to be solved by this invention is to provide a high-pressure discharge lamp which includes a cathode body composed of the cathode made of tungsten or tungsten alloy, and a lead rod inserted in a lead rod insertion hole of this cathode; and that has a long service life wherein, after the lamp is turned on, formation of irregularities on the surface of the cathode tip is prevented and the flickering phenomenon is prevented from occurring for a long time.

Means for Solving the Problems

To solve the above problem, the high-pressure discharge lamp according to this invention is characterized in that the cathode has a carbonized layer formed on a surface thereof exposed to a discharge space (except for a tip portion thereof) and on an inner surface of the lead rod insertion hole.

The carbonized layer is made of tungsten carbide ($W_2C$).

The carbonized layer has a thickness of 20 to 40 μm.

Effect of the Invention

In the high-pressure discharge lamp according to this invention, a carbonized layer is formed on surfaces of the cathode exposed to the discharge space so that carbon is diffused not only from the surface in the tip portion of the cathode but also from the surface in a rear end portion to maintain generation of CO on the cathode surface.

Moreover, the carbonized layer formed also on the inner surface of the lead rod insertion hole allows for carbon diffusion from inside of the cathode toward the surface during illumination, which makes it possible to sustain generation of CO on the cathode surface for a long time. The sustained generation of CO maintains the level of carbon monoxide CO in the light-emitting part so that the amount of C+ ions in the arc is maintained. Formation of tungsten carbides such as $W_2C$ and WC at the tip of the cathode 2 consequently prevents generation of irregularities at the tip of the cathode and as a result the service life before flickering starts can be prolonged.

MODE FOR CARRYING OUT THE INVENTION

Figure 1:
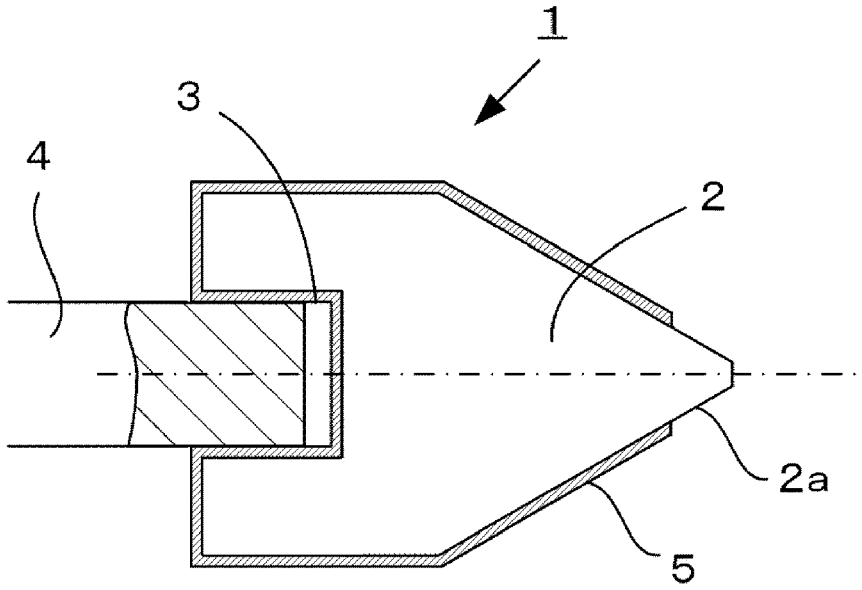
FIG. 1 is a cross-sectional view of a first embodiment of an electrode body used in the high-pressure discharge lamp of the present invention.

FIG. 1 is a cross-sectional view in one embodiment of an electrode body used in the high-pressure discharge lamp of the present invention. A cathode body 1 includes a cathode 2 made of tungsten or tungsten alloy, and a lead rod 4 inserted into a lead rod insertion hole 3 bored at the rear end of the cathode. A carbonized layer 5 is formed on surfaces of the cathode 2 exposed to the discharge space except for a tip portion 2*a*.

The tungsten may contain impurities as much as would be mixed in during the refining process of tungsten. The tungsten alloy is an alloy of tungsten W and thorium oxide $ThO_2$, or the oxide of rare earths such as cerium Ce and lanthanum La. The alloy may contain intermetallic compounds between these oxides and tungsten.

The cathode 12 may be formed by joining tungsten and tungsten alloy together.

As described above, the carbonized layer 5 is formed on surfaces of the cathode 2 exposed to the discharge space. In so far as the effect of the present invention is achieved, there may be parts where no carbonized layer is provided, or where the carbonized layer is thin.

In the case of using tungsten carbide for this carbonized layer 5, the carbonized layer should preferably contain carbon C in an amount of 0.44 to 0.53 g/cc.

Too large an amount of carbon C would lead to excessive generation of CO on the cathode surface, which will cause the carbon C to be transported not only to the surface of the cathode tip but also to the surface of the anode tip, where tungsten carbides such as $W_2C$ and WC will be formed. Since the surface of anode tip is heated to a higher temperature than the surface of cathode tip during the time when the lamp is illuminated, the carbides on the surface of anode tip will vaporize, which leads to unwanted acceleration of blackening of inner surfaces of the discharge vessel.

On the contrary, too small an amount of carbon C would lead to early irregularities of the tip of the cathode due to insufficient generation of CO on the cathode surface, which allows the arc discharge point to move more easily and causes flickering.

The carbonized layer 5 should preferably have a thickness of 20 to 40 μm.

Too large a thickness of the carbonized layer would lead to excessive generation of CO on the cathode surface, which will cause the carbon C to be transported not only to the surface of the cathode tip but also to the surface of the anode tip, where tungsten carbides such as $W_2C$ and WC will be formed. These carbides vaporize and accelerate blackening of inner surfaces of the discharge vessel.

Too small a thickness of the carbonized layer would lead to early irregularities of the tip of the cathode due to insufficient generation of CO on the cathode surface, which causes flickering.

This carbonized layer 5 is not formed to the tip portion 2*a* of the cathode 2. Thoriated tungsten which is the material of the cathode 2 has a melting point of 3420° C., while the substances that form the carbonized layer 5 have a lower melting point than that (for example, the melting point of tungsten carbide is about 2800° C.). If the carbonized layer 5 is formed to the tip portion 2*a* of the cathode 2, the carbonized layer 5 on the tip portion 2*a* will melt excessively during the illumination, leading to earlier occurrence of the flickering.

This is why the carbonized layer 5 is not formed at the point where it will reach a temperature at which it melts, i.e., the tip portion 2*a*. Specifically, the carbonized layer 5 is not formed in an area of 3 to 5 mm from the tip in the case of a xenon lamp of about 2 to 6 kW.

In the present invention, the carbonized layer 5 is formed also on inner surfaces of the lead rod insertion hole 3 of the cathode 2.

Figure 2:
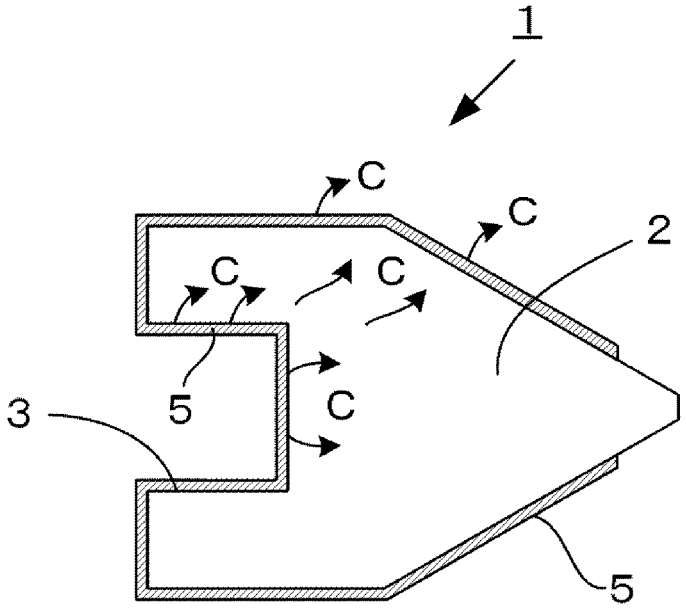
FIG. 2 is a diagram for explaining the behavior of carbon at the cathode in the present invention.
Figure 3:
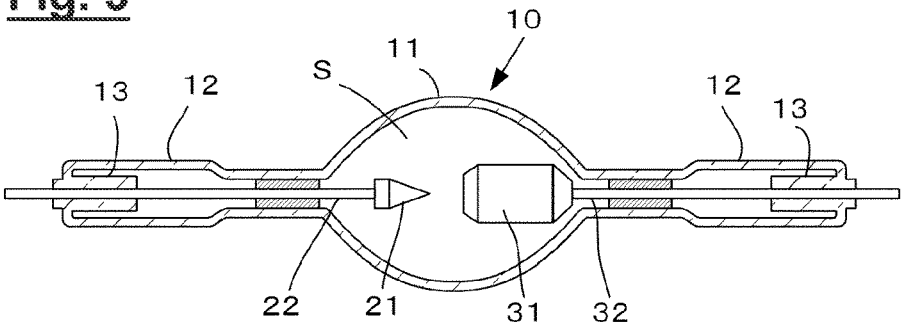
FIG. 3 is a cross-sectional view of a conventional high-pressure discharge lamp.
Figure 4:
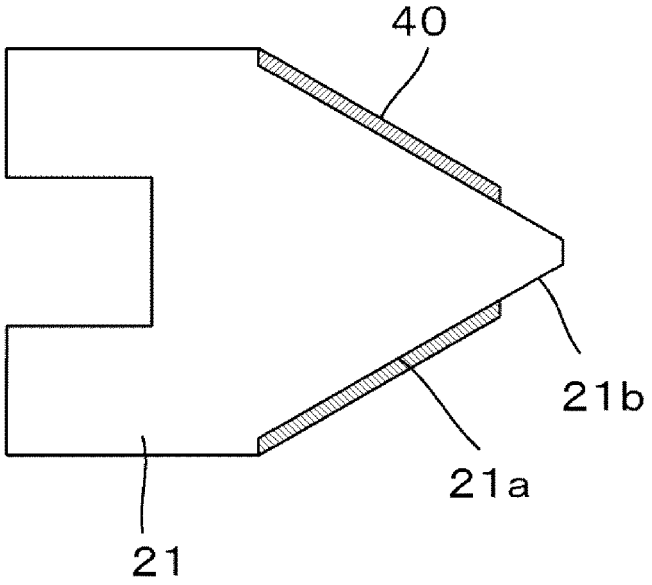
FIG. 4 is a cross-sectional view of a conventional cathode.
Figure 5:
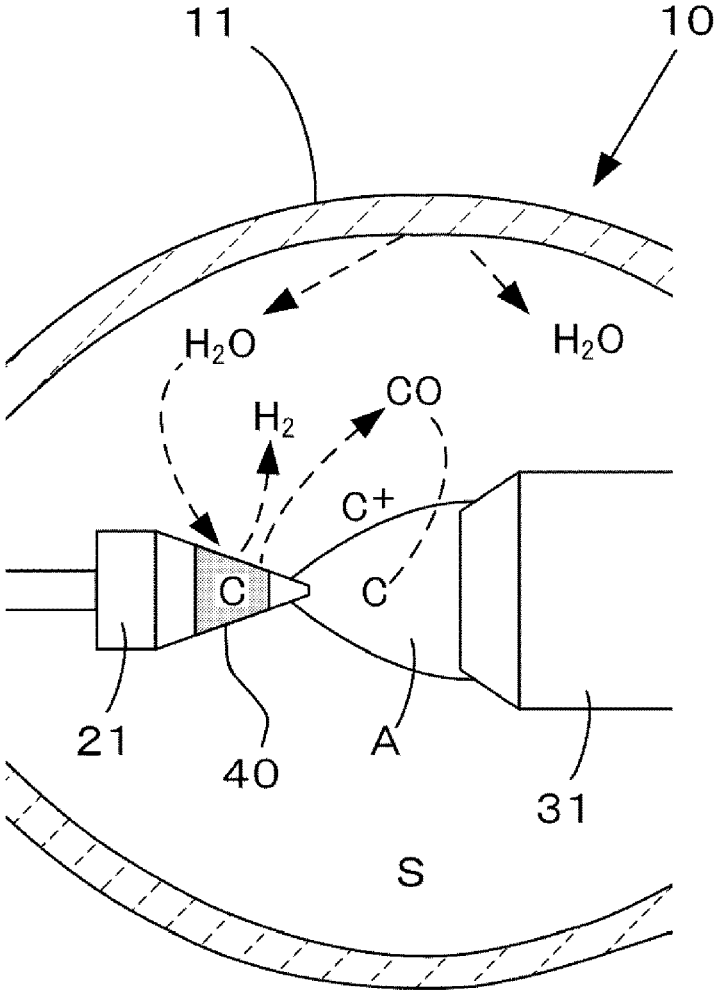
FIG. 5 is a diagram for explaining the behavior of carbon in a tip portion of the conventional cathode.

As illustrated in FIG. 2, while the carbon C in the carbonized layer 5 formed on the surface of the cathode 2 is consumed and reduced with the illumination time, the carbon C in the carbonized layer 5 on the inner surface of the lead rod insertion hole 3 is gradually diffused into the cathode 2.

This carbon C diffused from the lead rod insertion hole 3 into the electrode gradually reaches the cathode surface and contributes to the generation of CO on the cathode surface.

The inner surface temperature of this lead rod insertion hole 3 is lower than the temperature on the surface of the cathode, because of which the carbon diffusion from the carbonized layer 5 of the lead rod insertion hole 3 and from the carbonized layer 5 of the cathode surface occur with a time difference. This allows the carbon to be replenished at about the time when carbon in the carbonized layer 5 on the cathode surface is consumed and reduced, so that depletion of carbon in the carbonized layer 5 on the cathode surface is inhibited.

In so far as the effect of the present invention is achieved, there may be parts where no carbonized layer is provided, or where the carbonized layer is thin, on the inner surface of the lead rod insertion hole 3.

For the formation of such a carbonized layer 5, a gas-phase carbonization method may be utilized. The gas-phase carbonization is a method wherein a mixture gas of benzene and hydrogen is made to react with the cathode heated in a high-frequency heating device.

A process gas which is a mixture of benzene and hydrogen is supplied to a reaction chamber to flow at a rate of about 2 L/min. The cathode inside the reaction chamber is heated to about 1900° C. by high-frequency heating and kept at the high temperature for 5 minutes. The mixture gas is replaced with hydrogen gas, the temperature is reduced to about 1700° C. and this temperature is maintained for 5 minutes. This process is repeated several times until a cathode body with a carbonized layer of about 30 μm formed thereon is obtained.

The carbonized layer 5 is thus formed entirely on outer surfaces of the cathode 2 as well as on inner surfaces of the lead rod insertion hole 3. After that, the carbonized layer is removed by a machining process from the tip portion 2*a* of the cathode 2.

In the high-pressure discharge lamp according to this invention, a carbonized layer is formed on the surface of the cathode exposed to the discharge space (except for the tip portion) to maintain generation of CO on the cathode surface. Moreover, the carbonized layer formed on the inner surface of the lead rod insertion hole allows for carbon diffusion from inside of the cathode toward the surface during illumination, which makes it possible to sustain generation of CO on the cathode surface over a long time.

DESCRIPTION OF REFERENCE SIGNS

1 Cathode body
2 Cathode
2*a* (Cathode) tip portion
3 Lead rod insertion hole
4 Lead rod
5 Carbonized layer

The invention claimed is:

1. A high-pressure discharge lamp comprising a cathode body composed of a cathode made of tungsten or tungsten alloy and a lead rod inserted in a lead rod insertion hole of the cathode, the cathode having a carbonized layer made of tungsten carbide ($W_2C$) formed on a surface thereof exposed to a discharge space (except for a tip portion thereof) and on an inner surface of the lead rod insertion hole, the carbonized layer containing carbon in an amount of 0.44 g/cc to 0.53 g/cc.

2. The high-pressure discharge lamp according to claim 1, wherein the carbonized layer has a thickness of 20 to 40 sm.

3. The high-pressure discharge lamp according to claim 1, wherein the cathode is formed by joining tungsten and tungsten alloy.

* * * * *